US006876323B2

(12) United States Patent
Feldle et al.

(10) Patent No.: US 6,876,323 B2
(45) Date of Patent: Apr. 5, 2005

(54) AMPLITUDE AND PHASE-CONTROLLED ANTENNAS-SUBSYSTEM

(75) Inventors: Heinz-Peter Feldle, Senden (DE); Helmut Leier, Gruibingen (DE); Wolfang Menzel, Ulm (DE); Marc Schreiner, Ulm (DE)

(73) Assignee: EADS Deutschland GmbH, Ottobrunn (DE)

( * ) Notice: Subject to any disclaimer, the term of this patent is extended or adjusted under 35 U.S.C. 154(b) by 0 days.

(21) Appl. No.: 10/338,886

(22) Filed: Jan. 9, 2003

(65) Prior Publication Data

US 2003/0218566 A1 Nov. 27, 2003

(30) Foreign Application Priority Data

Jan. 9, 2002 (DE) ..... 102 00 561
Jan. 19, 2002 (DE) ..... 102 00 561

(51) Int. Cl.[7] ..... G01S 7/28

(52) U.S. Cl. ..... 342/175; 342/81; 342/157; 342/372

(58) Field of Search ..... 342/81, 157, 361, 342/368, 372, 375; 343/853, 893, 909

(56) References Cited

U.S. PATENT DOCUMENTS 5,446,464 A * 8/1995 Feldle ..... 342/175
5,644,277 A * 7/1997 Gulick et al. ..... 333/246
5,940,031 A 8/1999 Turlington et al.
6,166,705 A 12/2000 Mast et al.

FOREIGN PATENT DOCUMENTS

| | | |
|---|---|---|
| EP | 0718907 | 6/1996 |
| EP | 0726612 | 8/1996 |
| JP | 09130319 | 5/1997 |

OTHER PUBLICATIONS

Frank Jay, "IEEE Standard Dictionary of Electrical and Elecronics Terms", the term –duplexer–, p. 282.*
Search Report.

* cited by examiner

*Primary Examiner*—Thomas H. Tarcza
*Assistant Examiner*—Isam Alsomiri
(74) *Attorney, Agent, or Firm*—Crowell & Moring LLP

(57) ABSTRACT

A radar system with a phase controlled antenna array that contains a number of data and supply networks (2), which are installed so that they are interchangeable, and a transmit/receive module (3) containing a transmitter and receiver circuit (4) as well as a number of circulator circuits (8) and a number of antenna elements (9) that are coupled via a circulator circuit (8) to the transmitter and receiver circuit (4). Transmitter and receiver circuits (4), circulator circuits (8), and antenna elements (9) are combined in each transmit/receive module (3) and the transmit/receive modules (3) are arranged interchangeably on the radiation side of the radar or EW system (1).

21 Claims, 4 Drawing Sheets

AMPLITUDE AND PHASE-CONTROLLED ANTENNAS-SUBSYSTEM

BACKGROUND AND SUMMARY OF THE INVENTION

This application claims the priority of Application No. 102 005613, filed Jan. 19, 2002, in Germany, the disclosure of which is expressly incorporated by reference herein.

The invention concerns a phase controlled antenna subsystem with a passive antenna array which is especially applicable to a radar system, an SAR, for antennas in systems for electronic warfare or deployment guidance, as well as for navigation and communication systems. Possible platforms for the integration of the functions according to the invention are ground, naval systems, airplanes, satellites, drones and guided missiles, as well as buildings or vehicle bound-systems.

A radar system with phase controlled antenna array is known from U.S. Pat. No. 5,940,031 which contains a data and supply network and a number of installed and interchangeable transmit/receive modules containing a transmitter and receiver circuit and a number of antenna elements coupled via circulator circuits with the transmitter and receiver circuits. With the known radar system, the transmit/receive module is installed at the rear side of the data and supply network, which is constructed in several layers containing a cooling element structure, an power supply structure and a high frequency supply structure. From the transmit/receive modules that had been installed on the backside of the data and supply network, high frequency connection elements are installed on the respective antenna element at the front-side of the data and supply network and connected to the coupled circulator circuit in each case. The transmit/receive modules are interchangeable from the backside of the data and supply network, so that the radar system must be accessible from the rear side for maintenance.

Published highly miniaturized transmit/receive modules are manufactured without internal circulators and internal radiating elements. Therefore, their RF performance suffers on a high amount of RF losses and electrical and mechanical interfaces.

One difficulty exists in many application areas of radar and ECM systems (ECM=Electronic Counter Measures) with active phase controlled antenna arrays, e.g., for airplanes: There is very little space available for the accommodation of the radar system, and access from the rear is often impossible or only possible under difficult circumstances.

It is an objective of the present invention to provide a radar system of the above-mentioned type that requires little volume whereas the transmit/receive modules are easily interchangeable for maintenance and repair work.

A radar system with a phase controlled antenna array according to the present invention includes a data and supply network and a number of transmit/receive modules arranged interchangeably on the data and supply module containing in each case, transmitter and receiver circuits, a plurality of circulator circuits and a plurality of antenna elements coupled via the circulator circuits with the transmitter and receiver circuits. According to the invention, the transmitter and receiver circuit, related control electronic, circulator circuit and antenna element are combined in each transmit/receive module, and the transmit/receive module is arranged interchangeably on the irradiation side or at the front side of the radar system.

An essential advantage of the radar system of the invention is that an exchange of the transmit/receive module can take place from the irradiation side or front side of the radar system, which is very advantageous for many applications. It is another advantage of the radar system of the present invention that the antenna array can be adjusted to a curved surface when a structure-integrated antenna or conformal antenna is desired. Another advantage of the radar system of the present invention are the reduced number of RF interfaces and use of short high frequency lines to the antenna and therefore a low noise figure, lower high frequency losses and a low signal coupling. Finally, it is an advantage of the radar system of the present invention that a simple construction of the data and supply network is possible.

By use of modified transmit/receive modules (without amplifiers for transmit and receive functions) passive phased antenna arrays can be realized also.

According to an advantageous embodiment of the invention, the transmitter and receiver circuit, the circulator circuit, and the antenna element are integrated in the form of a multi-layered structure into the transmit/receive module.

Preferably, the antenna element is installed in the form of a planar antenna at the upper side of the transmit/receive module.

According to another preferred embodiment of the invention, the multi-layered construction contains several substrates arranged one on top of the other that carry the components of the transmitter and receiver circuits and the circulator circuit.

According to another advantageous embodiment, a first substrate is arranged on the side of the transmit/receive module facing the data and supply network which carries a high frequency power amplifier of the transmitter and receiver circuit to improve heat removal.

According to yet another advantageous embodiment, a second substrate is installed on the side of the transmit/receive module facing away from the data and supply network, and the circulator circuit carries the antenna element, as well as parts of the transmitter and receiver circuit. This makes possible a reduction of the space requirement, as well as an optimization of the noise level.

According to an advantageous further development of the above-named embodiments, at least one additional substrate is installed between the first substrate and the second substrate that carries additional circuits, especially a high frequency processing part and/or a digital processing part.

According to another advantageous embodiment of the radar system according to the invention, the substrates are constructed in one piece with a frame structure that simultaneously forms a housing of the transmit/receive module and a mechanical connection among the substrates.

Preferably, the data and supply network is a mechanical carrier structure for the transmit/receive module that simultaneously contains a cooling structure for the transmit/receive module.

Preferably, the data and supply network is multi-layered structure that contains a cooling structure in the form of a first layer and at least one more, a high frequency data and power supply network containing a circuit structure in the form of a second layer.

The cooling structure is preferably installed at the transmit/receive module facing the wall of the data and supply network, and the cooling structure is designed as an active cooling structure where cooling fluid flows through. Additionally, it is preferable that the first substrate carrying the high frequency power amplifier of the transmitter and receiver circuit stands in an intensive cooling contact with the thermal structure of the data and supply network.

According to an advantageous embodiment of the invention, the substrates and/or the frame structure has been manufactured of aluminum nitride (AIN). The substrates themselves are built in several layers of aluminum nitride and contain vertical and horizontal electrical contacts. Other substrate materials could also be used, but reduced performance (e.g. loss, thermal resistance) will be possible. Between the layers are electrical conductor lines (horizontal electrical contacts). These conductor lines are connected vertically with one another by a so-called vias (vertical electrical contacts).

According to another preferred embodiment of the invention, the substrates are stacked one above the other and soldered together. The solder connection consists preferably of hard soldering globules that the soldering material flows around. Preferably, the substrates are soldered together at the frame structures.

A metal sleeve that is fastened using solder, welding or gluing technology preferably encloses the sender/receiver module. The sleeve is preferably used to secure an electromagnetic screening of the module and the electrical contacts between the substrates and to seal off the module hermetically.

According to an additional preferred embodiment of the invention, an electrical connection is incorporated between the electrical contacts formed by the substrates within the frame structure.

The transmit/receive modules are preferably identical, and are installed at the irradiation side or the front side of the data and supply network.

Finally, according to an advantageous embodiment of the invention, the transmit/receive module is fastened with screws to the data and supply network at the edge or at the corner areas. A frame to fasten a number of transmit/receive modules (e.g. an arrangement for a subarray) could also be used.

Other objects, advantages and novel features of the present invention will become apparent from the following detailed description of the invention when considered in conjunction with the accompany drawings.

BRIEF DESCRIPTION OF THE DRAWINGS

Embodiments of the invention will be explained on the basis of the drawings, wherein.

DETAILED DESCRIPTION OF THE PREFERRED EMBODIMENTS

Figure 1:
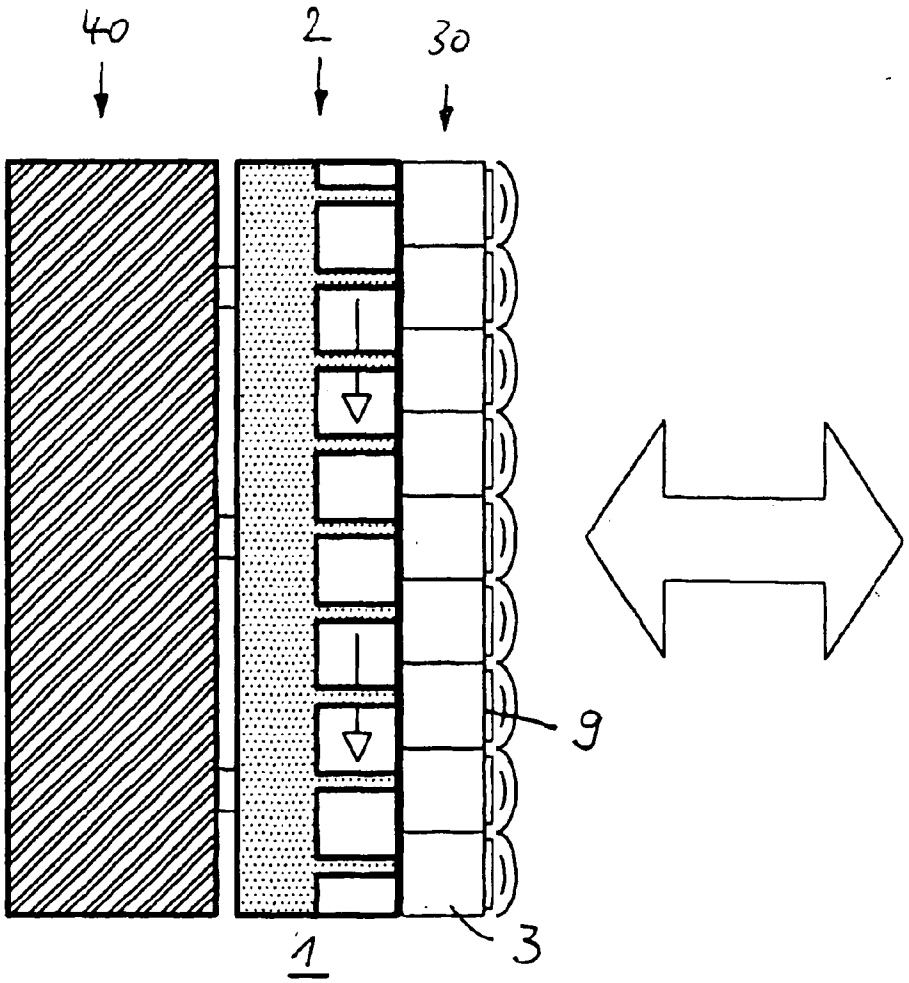
FIG. 1 is a schematic side view of the radar system with a phase controlled antenna array according to a first embodiment if the invention.

In the radar system shown in FIG. 1 as a schematic simplified side view that overall is designated with reference No. 1, antenna array 30 consists of a larger number of antenna elements 9. The antenna elements 9 are each a component of the transmit/receive module 3. The transmit/receive modules 3 are provided for an radiation and the receipt of a radar signal in the directions of the arrow. A data and supply network 2 is provided for supplying the transmit/receive module 3 with high frequency and data signals and for a power supply and cooling. A system circuit 40 is arranged on the reverse side of data and supply network 2 containing additional processing circuits of the radar system. The system circuit 40 can be installed separately from the data and supply network.

In particular when using the invention in an application system, e.g. in a radar system for airplane wings, only the transmit/receive module and the supply network is built into the wing, whereby the evaluating system can be accommodated somewhere else where more space is available.

Figure 2:
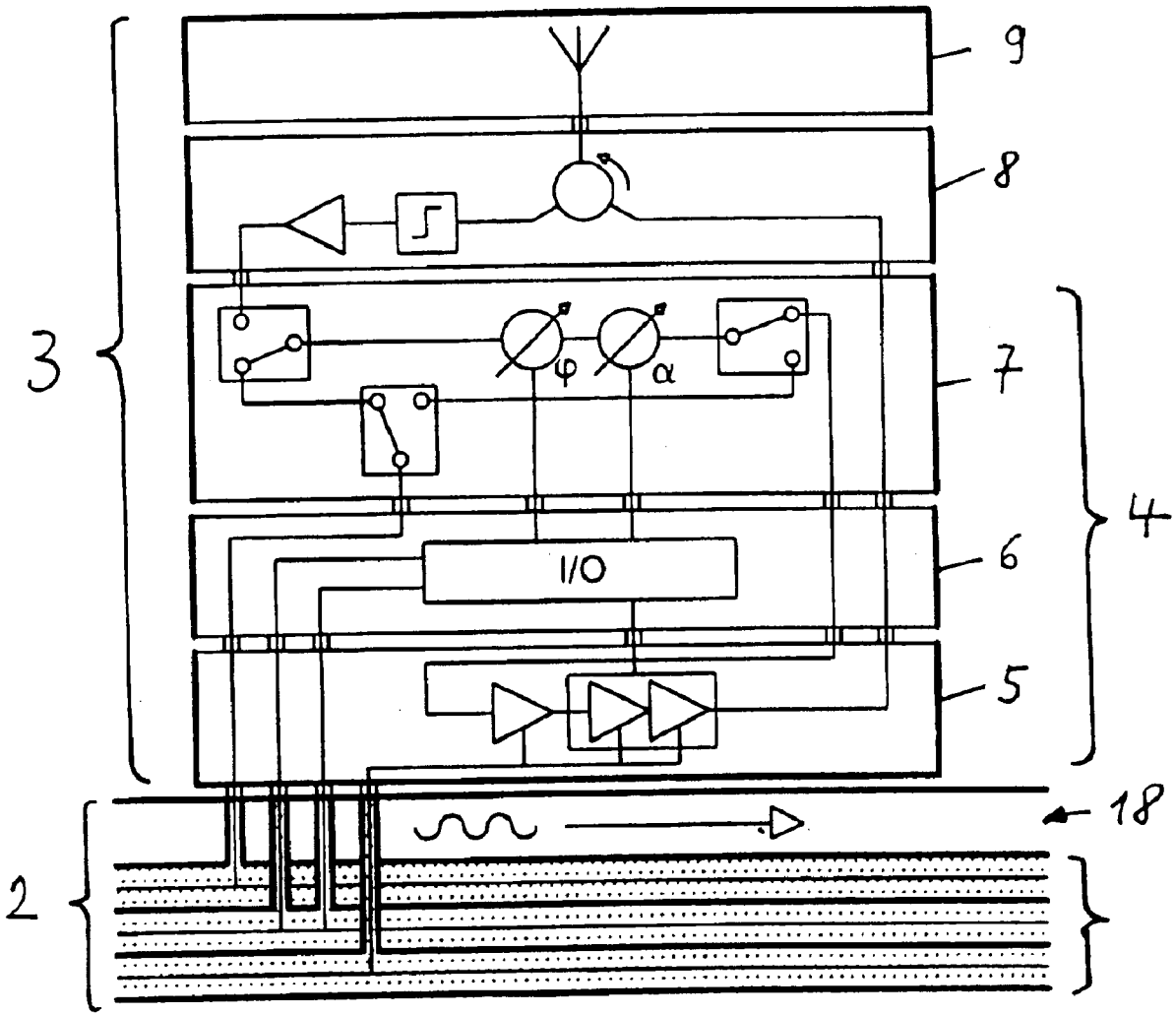
FIG. 2 is a schematic side view of a transmit/receive module from the embodiment of a radar system shown in FIG. 1 with a block diagram with its essential components.

As the enlarged schematic presentation of one of the transmit/receive module 3 shows in FIG. 2, the transmit/receive module 3 contains a transmitter and receiver circuit 4 which contains a high frequency amplifier arrangement 5 a digital processing part 6 and a high frequency processing part 7 . . . , and a limiter (LIM) and a low noise amplifiers (LNA) as part of 8. The transmitter and receiver circuit is coupled via a circulator circuit . . . CIRC (part of 8) to the antenna element 9 located at the upper side or front side of the transmit/receive module 3. Each transmit/receive module thus contains transmitter and receiver circuit 4, circulator circuit. CIRC (part of 8) and antenna element 9. The antenna element 9 is constructed as a planar antenna arranged on the front or upper side of the transmit/receive module 3.

The data and supply network 2, which carries the transmit/receive module 3 on its front or its irradiation side, is designed in the form of several layers containing the cooling structure 18 in the form of a first layer and additional circuit structures 19 containing high frequency, data and power supply networks in the form of a second layer. As is shown, the cooling structure 18 is arranged on the side of the data and supply network 2 facing the transmit/receive module 3 making an intensive thermal contact possible between the cooling structure 18 and the transmit/receive module 3, especially with its high frequency power amplifier.

Figure 3:
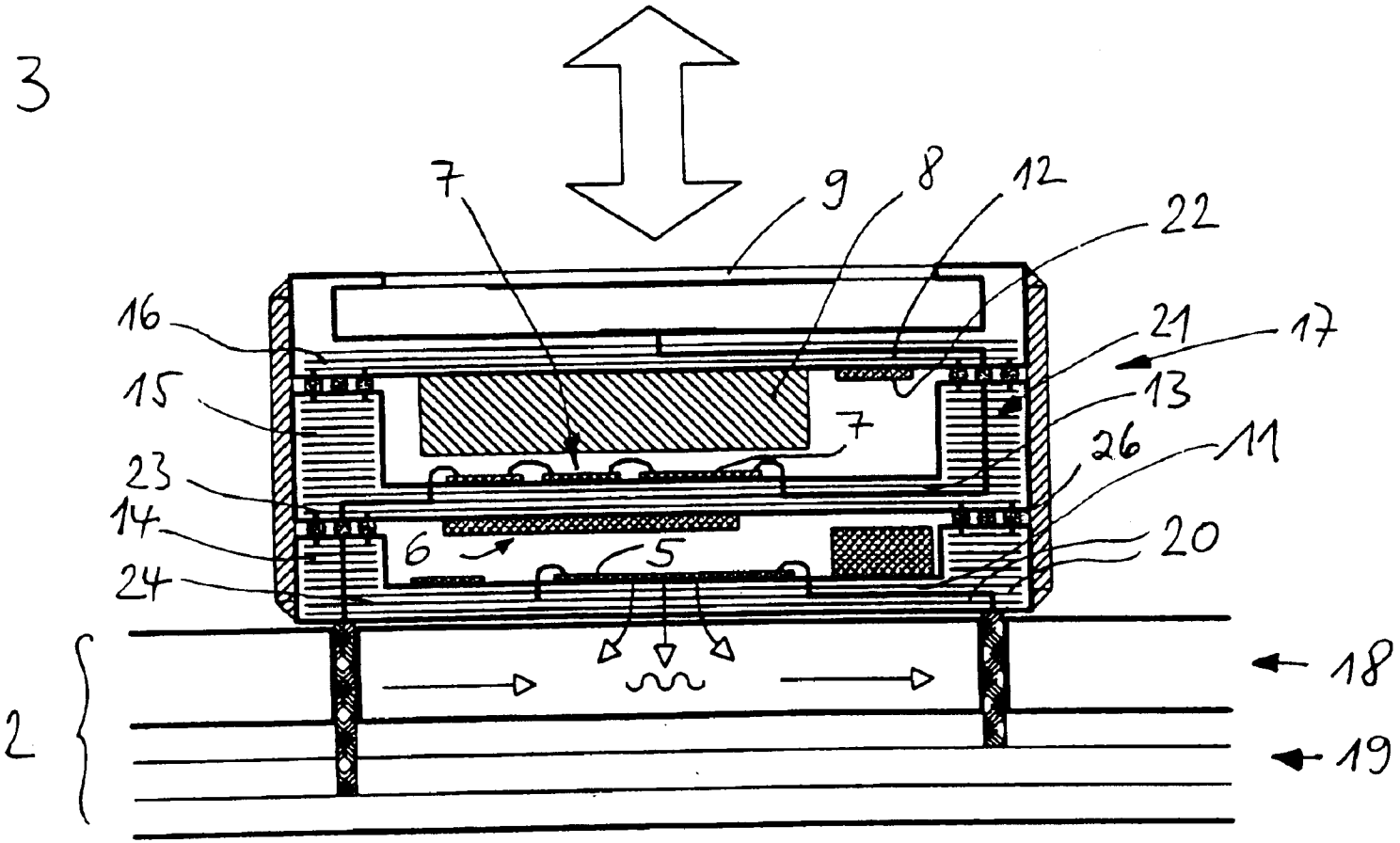
FIG. 3 shows a somewhat schematic side sectional view of the transmit/receive module according to a embodiment of the invention.

As can be seen in FIG. 3, which shows a construction of a transmit/receive module 3, the transmitter and receiver circuit 4 that contains the high frequency power amplifier 5, the digital processing part 6 and the high frequency processing part 7, and the circulator circuit CIRC (part of 8), are integrated in the form of a multi-layer structure into the transmit/receive module 3. The antenna element 9 is installed in form of a planar antenna on the upper or front side of the transmit/receive module 3.

The multiple layer structure contains several substrates 11, 12, 13 that are arranged on top of each other and carry the construction elements of the transmitter and receiver circuits 4 and the circulator circuit CIRC (part of 8). A first substrate 11 is installed at the side of the transmit/receive module 3 facing the data and supply network 2 and carries the high frequency power amplifier of the transmitter and receiver circuit 4. A second substrate 12 is arranged on the side of the transmit/receive module 3 facing away from the data and supply network and carries the circulator circuit 8, the planar antenna and parts of the transmitter and receiver circuits, essentially for space reasons and to improve the noise level. Between the first substrate 11 and a second substrate 12 a third substrate 13 is installed that carries additional circuits, including the digital processing part 6 and the high frequency processing part 7. The substrates 11, 12, 13 are made of one piece and constructed with the frame structures 14, 15 and 16. These frame structures 14, 15, 16 simultaneously form a housing 17 of the transmit/receive module 3 and a mechanical connection of substrates 11, 12, 13 among each other.

A metal sleeve advantageously at least partially encloses the transmit/receive module and is fastened with a soldering, welding or gluing technology. The sleeve is used advantageously to secure an electromagnetic screening of the module and the electrical contacts among the substrates and to seal the module hermetically. The sleeve has the reference number 26 in the drawings.

The data and supply network 2 is designed as a mechanical carrier structure for the transmit/receive module 3 and also contains a cooling structure 18 for the transmit/receive module 3. The first substrate 11 carrying the high frequency power amplifier 5 of the transmitter and receiver circuit 4 is in intensive thermal contact with the cooling structure 18 of the data and supply network 2.)

In addition, the data and supply network 2 is in form of a multi-layered structure that contains the cooling structure 18 in the form of a first layer and at least one circuit structure 19 containing a further high frequency data and power supply network in form of a second layer. As shown in the embodiment of FIG. 2 and in FIG. 3, the cooling structure 18 is installed on the side of the transmit/receive module 3 facing the side of the data and supply network 2. The first substrate 11 carrying the high frequency power amplifier 5 of the transmitter and receiver circuit 4 is in intensive cooling contact with the thermal structure 18 of the data and supply network 2. The cooling structure 18 is designed as an active thermal structure where cooling fluid flows through.

The substrates 11, 12, 13 and the one-piece connected frame structures 14, 15 and 16 consist preferably of aluminum (aluminum nitride) in order to guarantee an efficient heat removal. The substrates themselves consist of several layers of aluminum nitride and contain vertical and horizontal electrical contacts. The substrates 11, 12, 13 are stacked on top of one another and soldered together in the area of frame structures 14, 15, 16. For the soldering, preferably hard soldering globules 26 are used which soldering material flows around during the soldering process and connect the electrical contacts on the surface of the substrates. A blunt soldering without soldering globules is also possible. In the substrates 11, 12, 13 and the frame structures 14, 15, 16, horizontal electrical contacts 20, 21, 22 and vertical electrical contacts 23, 24, 25 are integrated, which form an electrical connection among the substrates 11, 12, 13, the data and supply network 2 and the individual components of the transmitter and receiver circuit 4. Electrical contacts 20, 21, 22, 23, 24 are integrated into the frame structures 14, 15, 16 forming an electrical connection among the substrates 11, 12, 13. Preferably, the transmit/receive modules 3 are identical.

Figures 4A, 4B:
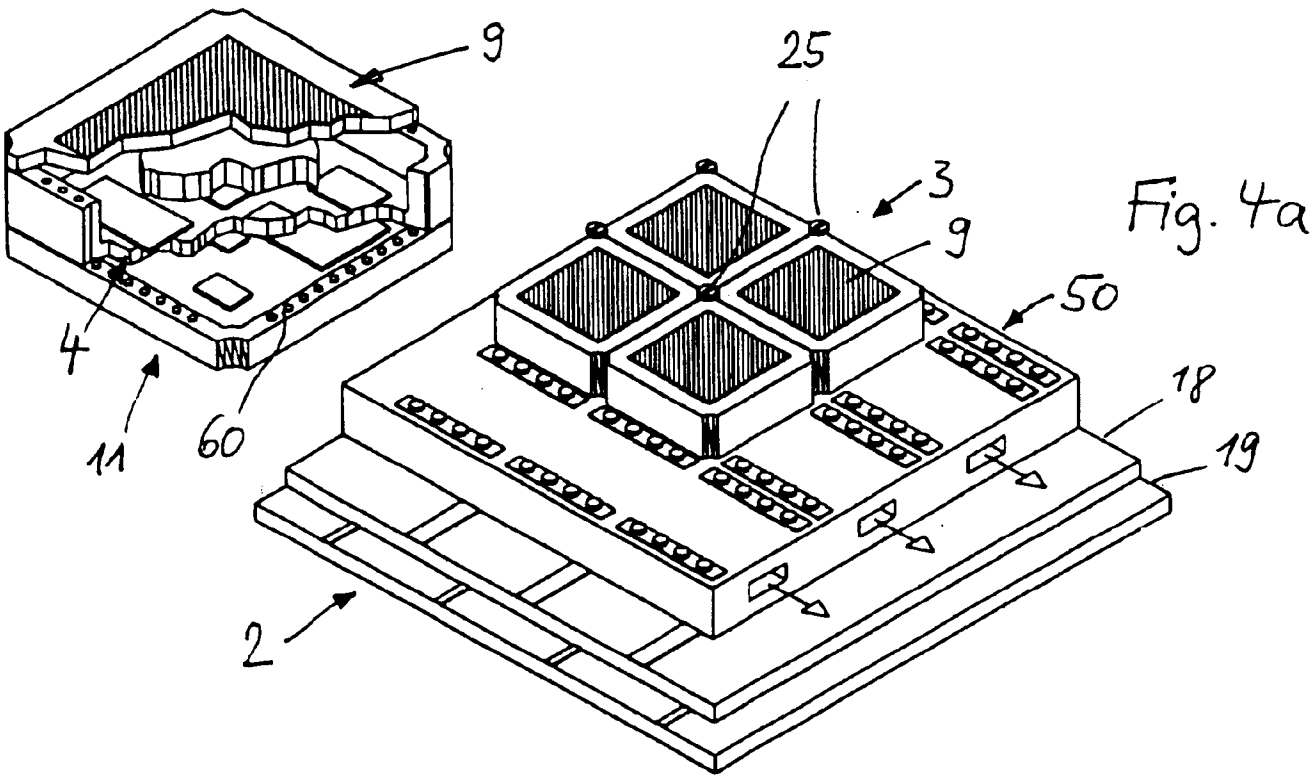
FIGS. 4*a* and 4*b* is a schematic perspective presentation of a part of the radar system with a phase controlled antenna array (FIG. 4*a*) and an enlarged broken open perspective presentation of an individual transmit/receive module (FIG. 4*b*).

The perspective presentation depicted in FIGS. 4*a* and 4*b* shows a small segment of a practical design of the antenna subsystem of a radar system or EW system according to the invention. Thus, it is obvious that the transmit/receive modules 3 are fastened on the irradiation side of the data and supply network 2 and tightened with screws 25 at the corner areas to the data and supply network 2. The electrical connections among the individual transmit/receive modules 3 and the data and supply network 2 is brought about through the electrical contact bars 50 that are installed at the upper side of the data and supply network 2 and through the cooling structure 18 by corresponding contact bars 60 at the bottom of the transmit/receive module 3. Contact bars at the bottom of the modules in FIG. 4*b* are not visible.

The module should be connected with the help of CIN: APSE contacts to the data and supply network. This is a flexible cylindrical wire mesh forming a pressure contact in the plastic enclosure that establishes an electrical connection between the two surfaces that are pressured from two sides. The module is preferably connected with the help of such flexible pressure contacts with the data and supply network.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A radar system with a phase-controlled antenna array, said radar system comprising:

a plurality of data and supply networks interchangeably arranged;

a plurality of transmit/receive modules, each of said modules including one of a plurality of transmitter and receiver circuits, one of a plurality of circulator circuits, and one of a plurality of antenna elements with each said plurality of antenna elements being coupled through a respective one of said circulator circuits to a respective one of the transmitter and receiver circuits;

wherein each one of said plurality of transmitter and receiver circuits, each one of said plurality of circulator circuits, and each one of said plurality of antenna elements are combined in each respective one of said transmit/receive modules, wherein each of said plurality of data and supply networks including a cooling structure for the respective transmit/receive module, and wherein each of said plurality of transmit/receive modules is arranged interchangeably on a radiation side of the radar system and wherein the cooling structure is installed on a side of the data and supply network facing the transmit/receive module.

2. The radar system according to claim 1, wherein each one of the said plurality of the transmitter and receiver circuits and a corresponding each one of said plurality of circulator circuits is integrated in the form of a multi-layered structure into a respective each one of the transmit/receive modules.

3. The radar system according to claim 1, wherein each of the plurality of the antenna elements is installed in the form of a planar antenna on the top side of each corresponding one of said transmit/receive modules.

4. The radar system according to claim 2, wherein the multi-layered structure contains several substrates that are built one on top of the other carrying the construction elements of each of the transmitter and receiver circuit and the circulator circuits.

5. The radar system according to claim 4, wherein the substrates are stacked on top of one another and are soldered together.

6. The radar system according to claim 4, wherein a first substrate is arranged on the side of each transmit/receive module facing the data and supply network and carries a high frequency power amplifier of the transmitter and receiver circuit.

7. The radar system according to claim 4, wherein a second substrate is arranged at the side of the transmit/ receive module facing away from the data and supply network and wherein said second substrate carries the circulator circuit.

8. The radar system according to claim 7, wherein at least one additional substrate is installed between the first substrate and the second substrate and said at least one additional substrate carries additional circuits including at least one of a high frequency processing part and a digital processing part.

9. The radar system according to claim 8, wherein each of said first, second and additional substrates are designed in one piece with a frame structure which also forms a housing of the transmit/receive module and a mechanical connection among first, second and additional the substrates.

10. The radar system according to claim 9, wherein the first substrate carries a high frequency power amplifier of the transmitter and receiver circuit which is in intensive cooling contact with a thermal structure of the data and supply network.

11. The radar system according to claim 9, wherein at least one of the substrates and the frame structure are made of aluminum nitride.

12. The radar system according to claim 9, wherein the substrates are soldered to the frame structures.

13. The radar system according to claim 9, wherein an electrical connection between the substrates is incorporated into the frame structure and forms electrical contacts.

14. The radar system according to claim 1, wherein the data and supply network is a mechanical carrier structure for the transmit/receive module.

15. The radar system according to claim 14, wherein the data and supply network is a multi-layered structure which contains the cooling structure in the form of a first layer and at least one more circuit structure containing a high frequency, data and power supply network in the form of a second layer.

16. The radar system according to claim 1, wherein the cooling structure is an active cooling structure through which cooling fluid flows.

17. The radar system according to claim 1, wherein the transmit/receive modules are identical.

18. The radar system according to claim 1, wherein each of the transmit/receive modules are attached to the irradiation side of the data and supply network.

19. The radar system according to claim 18, wherein the transmit/receive modules are attached with screws to the data and supply network at edge or corner areas.

20. The radar system according to claim 1, wherein each of the transmit/receive modules is at least partially enclosed by a sleeve.

21. A radar system comprising:

at least one data and supply network;

at least one transmit/receive module wherein each of said at least one transmit/receive module includes a transmitter and receiver circuit, a circulator circuit and an antenna element coupled through said circulator circuit to the one of said transmitter and receiver circuit wherein each of said at least one transmit/receive module is arranged interchangeably on a radiation side of the radar system, wherein each of said plurality of data and supply networks including a cooling structure for the transmit/receive module, and wherein the cooling structure is installed on a side of the data and supply network facing the at least one transmit/receiver module.

* * * * *